US005950914A

United States Patent [19]

Dunton et al.

[11] Patent Number: 5,950,914

[45] Date of Patent: Sep. 14, 1999

[54] SHIPPING AND DISPLAY CONTAINER

[75] Inventors: Kevin M. Dunton; Dale J. Waite; Michael E. Watanabe, all of Nampa; Coy L. Alexander, Meridian, all of Id.

[73] Assignee: Boise Cascade Corporation, Boise, Id.

[21] Appl. No.: 08/779,157

[22] Filed: Jan. 6, 1997

[51] Int. Cl.[6] ..... B65D 5/54

[52] U.S. Cl. ..... 229/122; 229/164; 229/220; 229/240

[58] Field of Search ..... 229/122, 164, 229/210, 220, 240; 206/772, 773, 774, 776

[56] References Cited

U.S. PATENT DOCUMENTS

| | | | |
|---|---|---|---|
| 1,186,920 | 6/1916 | Ledbetter | 229/122 |
| 1,649,211 | 11/1927 | Bitzer | 206/766 |
| 2,018,707 | 10/1935 | Daller | 206/773 |
| 2,797,040 | 6/1957 | Belsinger | 229/122 |
| 2,955,734 | 10/1960 | Barton . | |
| 3,079,058 | 2/1963 | Russell | 229/164 |
| 3,241,737 | 3/1966 | Steinbock . | |
| 3,863,829 | 2/1975 | Merrill . | |
| 3,881,648 | 5/1975 | Hall | 229/164 |
| 3,961,706 | 6/1976 | Roccaforte et al. . | |
| 4,053,101 | 10/1977 | Hart, Jr. . | |
| 4,350,281 | 9/1982 | Dornbusch et al. . | |
| 4,382,504 | 5/1983 | Vesborg . | |
| 4,542,847 | 9/1985 | Lindstrom . | |
| 4,871,067 | 10/1989 | Valenti | 229/164 |
| 5,277,360 | 1/1994 | DeMott | 229/164 |
| 5,413,276 | 5/1995 | Sheffer . | |
| 5,524,815 | 6/1996 | Sheffer . | |

OTHER PUBLICATIONS

Arzoumanian, Mark "Triangle Reduces to Gain", *Paperboard Packaging*, May, 1996, pp. 30–31.

*Primary Examiner*—Gary E. Elkins

*Attorney, Agent, or Firm*—Klarquist Sparkman Campbell Leigh & Whinston, LLP

[57] ABSTRACT

A shipping and display container for shipping and displaying goods is made from a unitary blank to have a bottom, a top, and a plurality of side panels, one of which has a display opening. The container also has a cover attached to a side edge of one of the side panels for covering the display opening during shipping. The cover can be removed for displaying the contents of the container. The top of the container allows another container to be stacked thereon, even while displaying its contents.

38 Claims, 4 Drawing Sheets

SHIPPING AND DISPLAY CONTAINER

FIELD OF THE INVENTION

The present invention relates to a container for shipping and displaying goods.

BACKGROUND OF THE INVENTION

With the advent of superstores and warehouse-like retail stores, more and more stores are leaving their merchandise in shipping boxes for displaying the merchandise. This practice results in reduced costs to the stores because they no longer need to pay someone to unload the merchandise from the shipping boxes and arrange it on the shelves.

In response to this practice, dual-purpose boxes have been developed that can be used for both shipping and displaying goods. Generally, the boxes have a shipping mode and a display mode. For shipping, the boxes should be sturdy and completely enclose the goods to protect them against damage from dirt or impact. For displaying however, the boxes should be at least partially open so that customers can view and access the goods within. Also, for displaying, the boxes should be stackable upon one another so that stores can make the most efficient use of their shelf space and should be attractive since they will be on display.

Additionally, the boxes should be easily and quickly convertible from their shipping mode to their display mode, otherwise the advantages of dual-purpose boxes are lost. As is desirable generally in boxes, dual-purpose boxes also should be lightweight, space-efficient, easily manufacturable, and produce little waste cardboard.

Prior attempts at designing dual-purpose boxes have resulted in designs having a lid that covers an opening in the container during shipping and that can be removed from the container to expose the opening, and thus the contents of the container, for display. However, these prior attempts to achieve all the goals discussed above have been unsuccessful. For instance, Lindstrom, U.S. Pat. No. 4,542,847, Merrill, U.S. Pat. No. 3,863,829, and Sheffer, U.S. Pat. No. 5,413,276, each disclose a combination shipping and display box. Each of the boxes has a front opening and a cover that covers the entire top of the box and the front opening. However, removing the cover of any one of these boxes to display the contents, also removes the entire top of the box. Thus, the boxes are not suitable for stacking when configured in the display mode.

DeMott, U.S. Pat. No. 5,277,360, discloses a stackable container that has a front opening for displaying and accessing the contents of the container and ledges for supporting another container on top. However, DeMott requires that a separate lid be used during shipping, thus making manufacture more difficult. Also, because DeMott's ledges are narrow, DeMott reinforces the ledges with a second side panel extending downwardly from the ledges, in effect creating a double-walled container. These double walls not only waste cardboard, but also consume valuable interior space of the container.

Also, it appears as if tape must be applied to the lid or cover of the containers in these patents to secure the lid or cover to the rest of the container once goods are loaded therein. Thus, to uncover the display opening, the tape holding down the lid or cover must be sliced or removed. Slicing the tape requires the use of a tool, such as a pocket knife, which if applied with too much pressure may cut through the cardboard to damage the goods inside. Also, removal of the tape may leave an unattractive appearance.

Another type of prior art container has a front panel with a perforated portion that is in place during shipping and that can be knocked out of the front panel to separate the perforated portion from the container to create a display opening, exposing the contents of the container. However, the perforations leave ragged and irregular edges on the opening, resulting in an unattractive, unfinished appearance.

Thus, a need exists for a container that overcomes the inadequacies of the prior containers. The primary objective of the present invention is to provide a stackable shipping and display container that is made from a minimal amount of material and that is easy to manufacture.

SUMMARY OF THE INVENTION

The present invention is a shipping and display container that is formable from a unitary blank, that is completely enclosed for shipping and that has a cover panel removable from the rest of the container to reveal a display opening in another panel so that the contents can be displayed. The container is readily collapsible for storage or shipment and yet has structural rigidity when assembled so that loaded such containers can be stacked.

In an illustrated embodiment of the invention, the container has a plurality of side panels, a top panel assembly, and a bottom panel assembly. The container can be used for both shipping and displaying goods and therefore has a shipping mode and a display mode. One of the side panels has a display opening that, in the shipping mode, is covered by a cover panel coupled to one of the other side panels. In the display mode, the display opening is exposed so that the contents of the container can be viewed and accessed.

More particularly, the cover panel is weakened along a line to allow the cover panel to be separated from the rest of the container. The weakened line of the cover panel is either remote from the display opening or hidden by the front panel, so that if separating the cover panel leaves an unfinished edge, the unfinished edge does not detract from the appearance of the container.

Another feature of the container of the invention is its formation from a single blank. Because the container is made from a single blank, the container is easy and economical to manufacture.

Still another feature is that when assembled, the container has a top ledge onto which another shipping and display container can be stacked.

Yet another feature of the container of the present invention is a top flap attached to the cover panel that tucks underneath at least a portion of the top panel assembly to secure the cover panel in the shipping mode. Tape is applied over the portion of the top panel assembly under which the top flap is tucked and to at least one of the side panels to hold the top flap underneath the top flap. The tape does not contact the top flap, which is advantageous because when converting the container from its shipping mode to its display mode, the top flap can be untucked without removing or slicing the tape. Also, since the tape remains on the top panel assembly and thus continues to secure the top panel assembly to the side panel, the container has greater stacking strength than a similar container with a loose top panel assembly. The top panel assembly and top flap are positioned so that existing taping machines, which apply tape along a line running parallel to and about midway between the panel with the display opening an opposing side panel, can be used.

Still another feature of the container of the invention is the provision of score lines on at least some of the panels, which allows the container to be collapsed flat when it is partially assembled. This is advantageous because the flat container can be shipped partially assembled to a location for packing, and the assembled container does not need to be completely disassembled after all the contents are removed at the retailer before collapsing it for recycling.

The foregoing and other objects and advantages of the invention will become more apparent from the following detailed description of the illustrated embodiments that proceeds with reference to the accompanying drawings.

DETAILED DESCRIPTION OF ILLUSTRATED EMBODIMENTS

Figure 1:
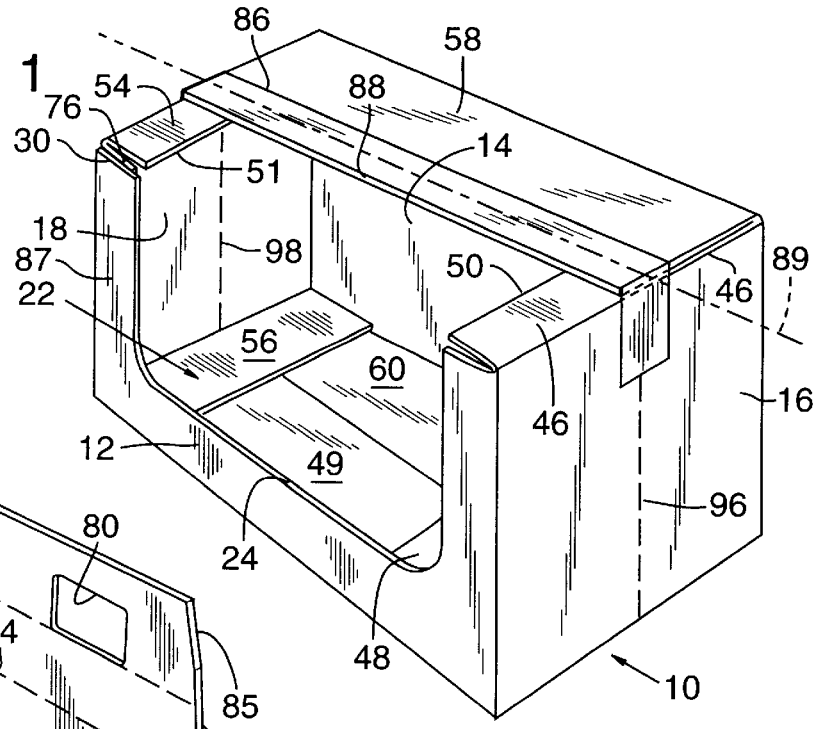
FIG. 1 is a perspective view of a shipping and display container in accordance with the present invention, as viewed toward the front and right sides and shown with a cover panel removed.

Referring to FIG. 1, a shipping and display container 10 of the present invention is shown assembled in a display mode. The container is formed from several panels into a rectangular box shape. More particularly, the container has a front side panel 12, a back side panel 14, a right side panel 16, a left side panel 18, a top panel assembly 20 (FIG. 2), and a bottom panel assembly 22, arranged to intersect adjacent panels at right angles. The front panel 12 has a die-cut display opening 24, which is uncovered when the container is in its display mode, for viewing and accessing the contents of the container, such as bagged items.

The assembled container 10 also has a shipping mode, shown in FIG. 2 in solid lines, in which the display opening 24 in the front panel 12 is covered by a removable cover panel 26, or flap, as will be described more fully below. In the shipping mode, the panels 12,14,16,18,20,22,26 enclose an interior chamber, as also more fully described below. The container can be easily converted from its shipping mode to its display mode by detaching cover panel 26.

Figure 3:
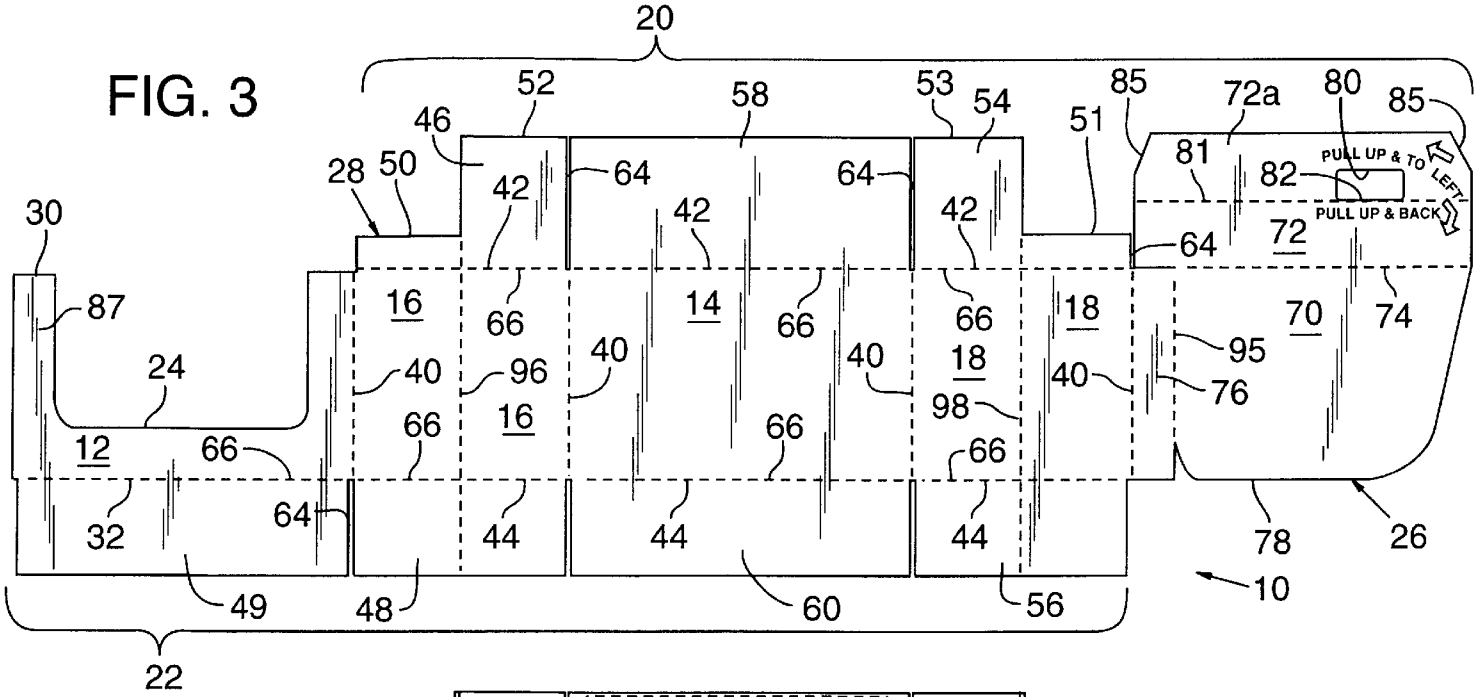
FIG. 3 is a top plan view of a cardboard blank used to form the container of FIG. 1.

A blank 28 for forming container 10 is shown in FIG. 3. The blank 28 is formed from a single, flat piece of material, preferably from corrugated cardboard or fiberboard. The unitary blank 28 may be cut with a flexo-graphic die cutter, a machine commonly used in the corrugated board industry for cutting, folding, gluing, and painting corrugated board.

The following description proceeds to describe the illustrated blank 28 and container 10 using words to describe locational relationships, such as "top," "bottom," "left," "right," etc. However, it should be understood that these words are used only for clarity in discussing the illustrated embodiment and that containers having different orientations are also contemplated by this invention. Also, generally these words are used in relation to the assembled container, as shown in FIGS. 1 and 2, unless specifically noted otherwise.

As shown in FIG. 3, front panel 12 is at the left end of blank 28. Display opening 24 in the front panel is substantially rectangular and is cut from an upper edge 30 of front panel 12 to extend nearly to a bottom edge 32 of the front panel, thus making front panel 12 substantially "U"-shaped.

Extending to the right from front panel 12, in order, are right side panel 16, followed by back side panel 14, and then left side panel 18. Cover panel 26 extends to the right in FIG. 3 from left side panel 18. Such panels are foldably connected to their respective adjacent panel or panels along parallel fold lines 40, which extend from the upper edges 30,42 to the bottom edges 32,44 of the panels. Front and back panels 12,14 are illustrated as being wider than the left and right side panels 18,16; however, the dimensions of the panels could be varied as desired to accommodate goods of different sizes and shapes.

Extending from upper edge 42 of right side panel 16 is a right top segment 46, and extending from bottom edge 44 of the right side panel is a right bottom segment 48. Right top segment 46 has a short forward portion 50 and a longer rear portion 52. Rear portion 52 extends upwardly from right side panel 16 preferably a distance somewhat greater than about half of the width (as seen in FIG. 3) of right side panel 16. Forward portion 50 extends upwardly from right side panel 16 a much shorter distance than right rear portion 52. Left side panel 18 also has top and bottom segments 54,56 attached thereto, both of which are mirror images of right top and bottom segments 46,48, respectively. Left top segment 54 has a short forward portion 51 and a long rear portion 53.

The illustrated forward and rear portions 50,51,52,53 have square corners; however, these corners could be radiused for ease of stripping during manufacture of the blank and for ease in removing the contents of the container, particularly bagged items.

Back panel 14 also has a back top segment 58 extending upwardly from its upper edge 42 and a back bottom segment 60 extending downwardly from its bottom edge 44. Back top segment 58 is the same height as right rear portion 52, and back bottom segment 60 is the same height as right side bottom segment 48. The front panel 12 also has a bottom segment 49, similar to back bottom segment 60. Each of the top and bottom segments 46,48,49,54,56,58,60 are cut and thus separated from their adjacent segments along lines 64 in continuation of their respective fold lines 40 between adjacent side panels from their attached edges 42,44, to their free edges. All the top and bottom segments 46,48,49,54,56,58,60 also are foldably attached to their respective side panels 12,14,16,18 along horizontal fold lines 66, which are coincident with their respective top and bottom edges 42,44.

Cover panel 26 has a display opening cover portion 70 and a top opening cover portion 72, also called a top flap, attached to display opening cover portion 70 at a fold line 74. Display opening cover portion 70 is the same height as the other side panels. In this way, when container 10 is assembled, display opening cover portion 70 bridges the top panel assembly 20 and bottom panel assembly 22 and helps the right, left and back side panels support the top panel assembly 20, and helps prevent buckling of front panel 12 that might otherwise occur during shipping when several loaded containers are stacked on one another.

The right side and a portion of the left side of display opening cover portion 70, nevertheless, are cut on a curve to facilitate conversion of the container from shipping mode to display mode, as described in detail later.

A narrow attachment strip 76 extends along a left side of display opening cover portion 70 and is connected to side panel 18, as shown in FIG. 3. The strip 76 extends from fold line 74 to the lower free edge 78 of cover portion 70. When the container is assembled, strip 76 is attached to front panel 12, as will be described in greater detail below. The right side of attachment strip 76 is perforated along line 95, or otherwise weakened, so that cover panel 26 can be easily detached from assembled container 10, as will also be described more fully below.

The top opening cover portion 72 extends upwardly from display opening cover portion 70, preferably to about the height of the rear portions 52,53 of the right and left top segments 46,54. Top opening cover portion 72 has a hand hole 80 slightly right of the center of such portion for assisting removal of cover panel 26 from the rest of the container along score line 95, as will be described in greater detail below. Top opening cover portion 72 preferably also has a score line 81 extending parallel to front panel 12 when the container is assembled, and crossing through the forward edge 82 of hand hole 80. Score line 81 allows top opening cover portion 72 to bend easily to facilitate opening container 10 when converting the container from its shipping mode to its display mode, as explained more thoroughly below. The upper corners 85 of top opening cover portion 72 preferably are chamfered, as shown.

Figure 2A:
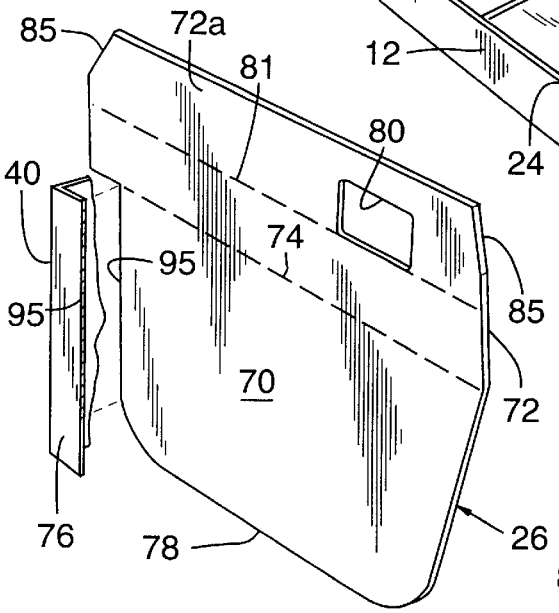
FIG. 2A is a broken-away perspective view of the cover panel of FIG. 2 after detachment from the container.
Figure 2:
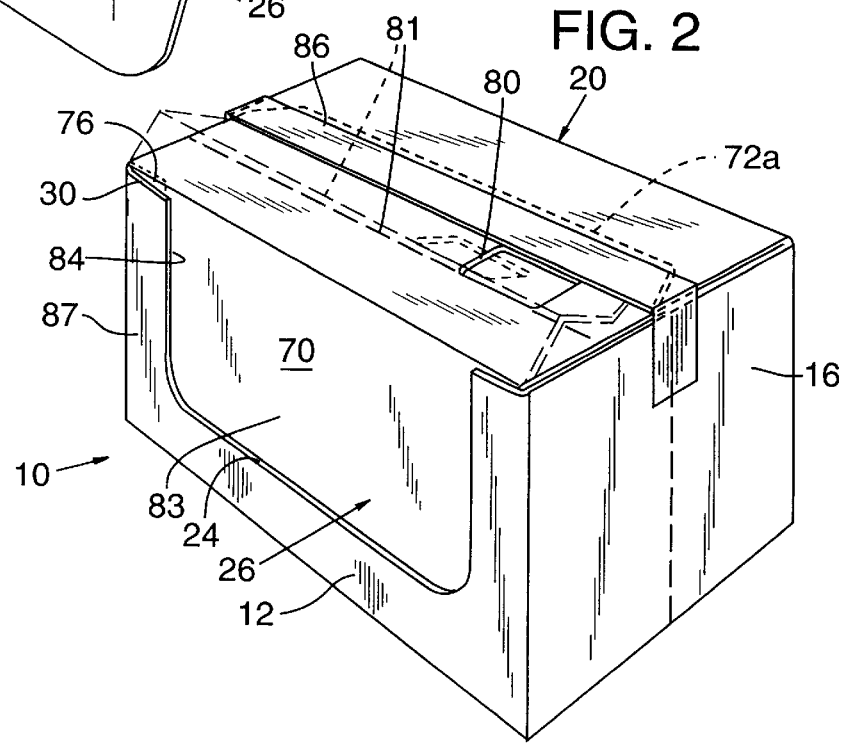
FIG. 2 is a perspective view similar to FIG. 1 of the container of FIG. 1, including the cover panel before removal.

Referring to FIGS. 2 and 3, container 10 is assembled into the shipping mode first by folding side panels 12,14,16,18 of blank 28 along fold lines 40 orthogonally to one another. Cover panel 26 is folded so that outer surface 83 of the cover panel portion 70 opposes the inner surface 84 of the front panel. Attachment strip 76 is then adhered, or otherwise affixed, to the mating portion 87 of front panel 12, thereby causing cover panel portion 70 to cover display opening 24 and help form supporting front sidewalls to the container 10.

The right and left bottom segments or flaps 48,56 are then folded inwardly along fold lines 44 orthogonally to the side panels 16,18, respectively, and the front and rear bottom segments 49,60 are then folded inwardly orthogonally to overlie the left and right bottom segments 48,56. A piece of tape (not shown) is then adhered to the seam where the front and rear bottom segments 49,60 meet, resulting in the formation of the bottom panel assembly 22. With the bottom panel assembly 22 intact, goods can then be loaded into container 10.

Next, the top panel assembly 20 is formed by folding down top segments 46,54,58 and the top opening cover portion 72 of cover panel 26. More specifically, right and left top segments 46,54 are folded along fold lines 66 inwardly and orthogonally to the side panels 12,14,16,18. Top opening cover portion 72 of cover panel 26 then is folded inwardly orthogonally along fold line 74 to overlie the entire forward portions 51,50 of left and right top segments 54,46 and a forward part of right and left rear portions 53,52 of right and left top segments 46,54. The back top segment 58 is then similarly folded downward along fold lines 66 to overlie right and left top segments 46,54, and the free rear part **72*a* of top opening cover portion 72, as shown in FIG. 2. In other words, the rear part 72*a* of top opening cover portion 72 underlies a forward part of back top segment 58**.

To secure the top of the container closed in its shipping mode, a second length of tape 86 is applied to the container, essentially with the center line of tape 86 running along the center line 89 of the container (about midway between front side panel 12 and back side panel 14). Tape 86 is secured to and extends up from left side panel 18, along back top segment 58, and down right side panel 16. The forward edge of the tape is aligned with the forward edge 88 of back top segment 58, as best see in FIG. 1. Thus, tape 86 only contacts back top segment 58 of the top panel assembly but nevertheless secures top opening cover portion 72 thereunder. As will be explained below, not having tape on the top opening cover portion 72 (or anywhere else on cover panel 26) allows the container to be simply, quickly converted from shipping mode to display mode simply by removing cover panel 26 from the rest of the container by pulling on the hand hold formed by hand hole 80, as explained more fully below.

Also, existing taping machines, which are set up to apply the center line of tape along the center line of a container, can still be used even though the tape is only applied to the back top segment 58 because forward edge 88 of back top segment 58 is forward of the center line of the container.

Once container 10 arrives at its destination, it is converted from shipping mode, as shown in FIG. 2, to display mode, as shown in FIG. 1. This conversion is accomplished by grabbing the cover portion 72 of cover panel 26 at exposed hand hole 80 and pulling cover portion 72 forward and upward. This causes rear part **72*a* of cover portion 72 to untuck from beneath back top segment 58 and bend outwardly from container 10 along score line 81, as shown in dashed lines in FIG. 2. The chamfered comers 85 allow the untucking to occur smoothly and easily. Once cover portion 72 is completely untucked, cover panel 26 is detached from the rest of container 10, as shown in FIG. 2A, by pulling cover portion 72 upwardly and to the left to break away cover panel 26 from the rest of the container along perforated line 95 on the side of attachment strip 76. The curvature of cover panel 26 allows a slight counterclockwise rotation of the cover panel while pulling at the hand hole to facilitate detachment. Note that no knives or other tools are needed to convert container 10** from its display mode to its shipping mode.

As shown in FIG. 1, in the display mode, the perforated edge 95 of the attachment strip 76 is substantially hidden from view by the adjacent portion of front panel 12. Also, back top segment 58 and right and left top segments 46,54 remain at the top of container 10, forming ledges upon which another shipping and display container can be stacked. Because tape 86 was not removed when the cover panel 26 was detached, the back top segment 58 is still secured to the rest of the container, providing the container with rigidity, and thereby greater stacking strength, than would be the case if back top segment 58 were loose.

Figure 4:
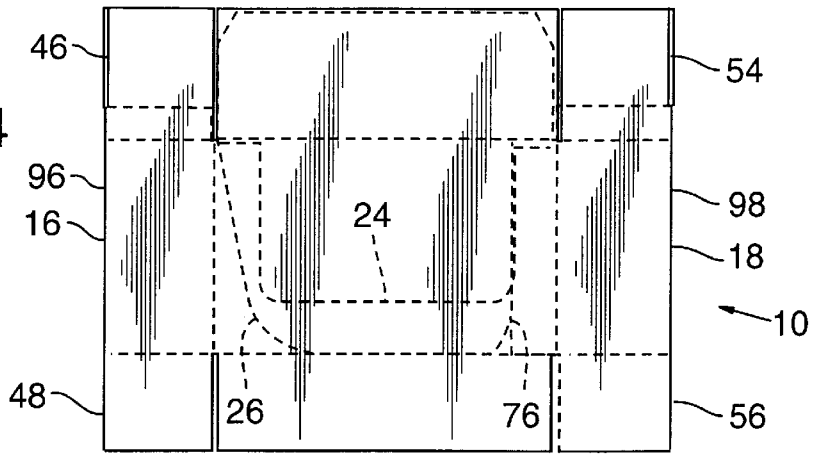
FIG. 4 is a rear side view of the container of FIG. 2 shown in a collapsed position.

Once the contents of container 10 are emptied, the container can be flattened into a collapsed state (FIG. 4) merely by removing tape 86 and the tape holding together the bottom panel assembly 22, and folding right and left side panels 16,18 and their respective top and bottom segments 46,48,54,56 upon themselves along score lines 96,98, which substantially extend from the upper edge to the lower edge of each of the panels and segments 16,18,46,48,54,56, as shown in FIG. 3. In this way, even with attachment strip 76 of cover panel 26 affixed to the interior surface of front panel 12, the container 10 can be laid flat, as illustrated in FIG. 4.

The collapsed state may also be a convenient one in which to ship the container from manufacturer to user for loading. In this case, the container would only be partially assembled initially by adhering attachment strip 76 to front panel 12. Then the container would be collapsed along score lines 96,98 until ready for final assembly and loading.

Figure 5:
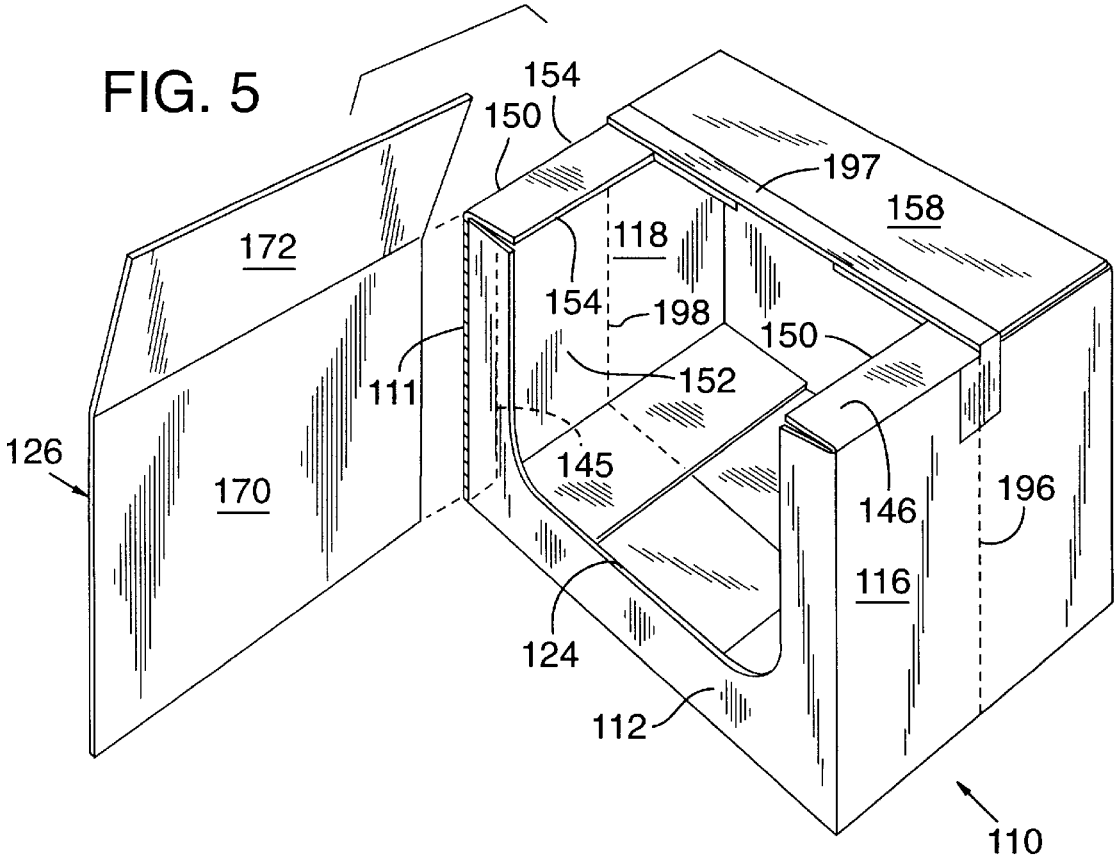
FIG. 5 is a perspective view, similar to those of FIGS. 1 and 2, of a shipping and display container in accordance with an alternative embodiment of the present invention, with its cover panel separated therefrom.
Figure 6:
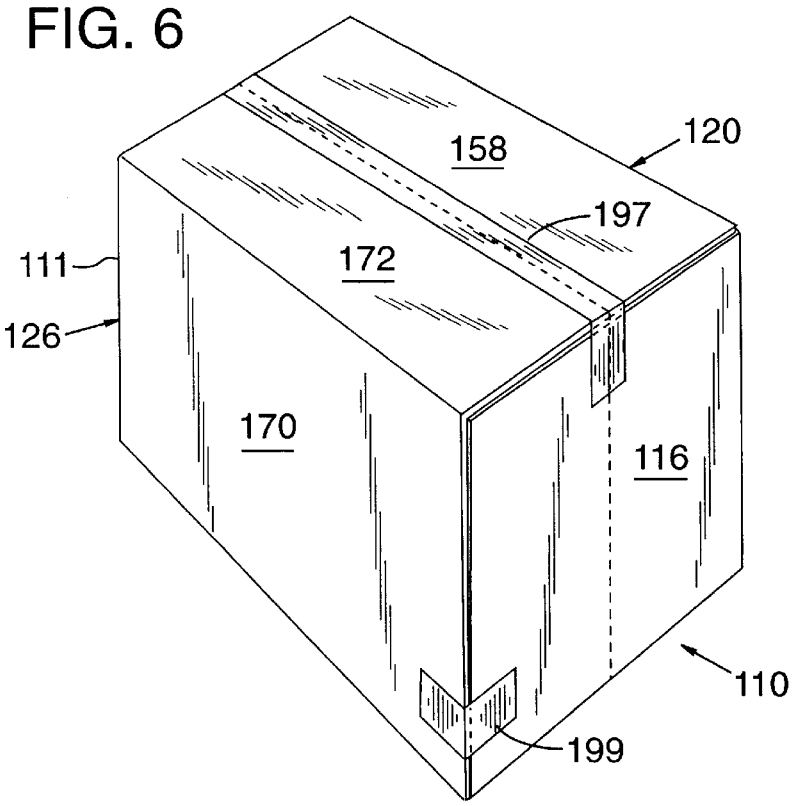
FIG. 6 is a perspective view of the container of FIG. 5, shown with its cover panel attached thereto and in its closed position.
Figure 7:
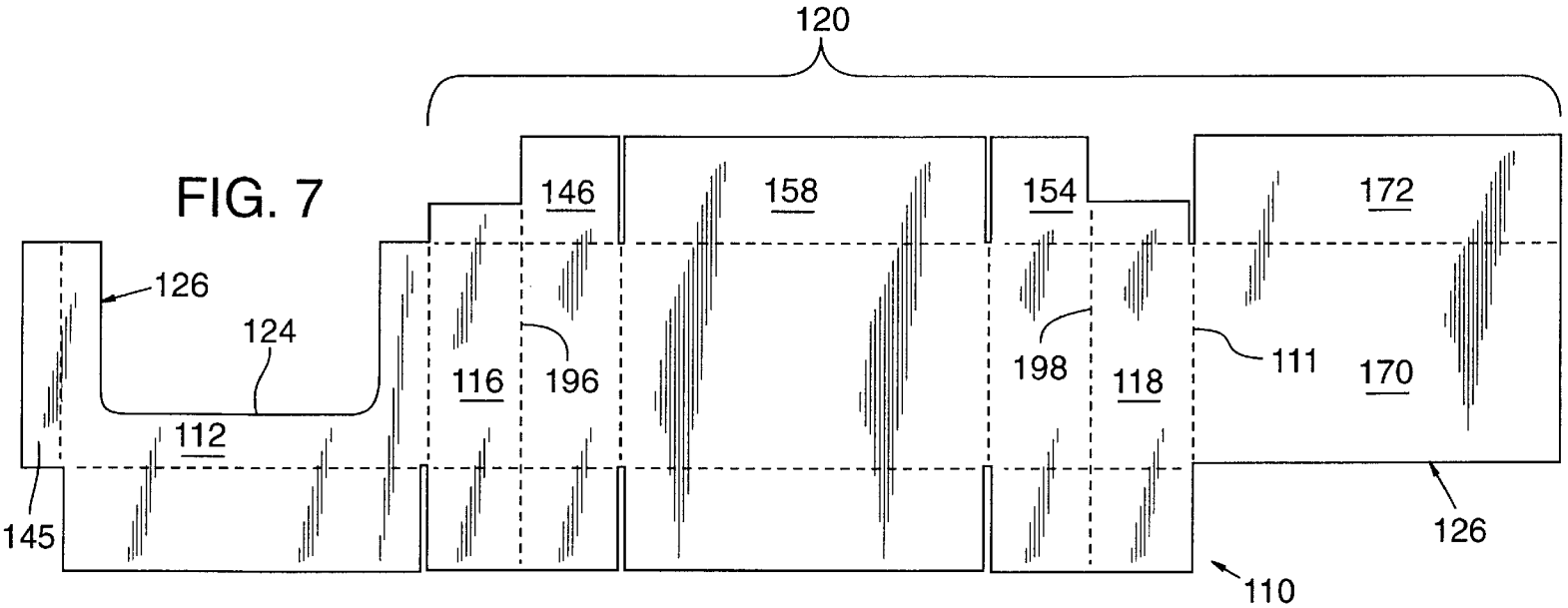
FIG. 7 is a top plan view of a cardboard blank used to form the container of FIG. 5.

Referring to FIGS. 5–8, an alternative embodiment of a container 110 of the present invention is shown. As shown in FIGS. 5 and 7, a cover 126 of the alternative embodiment is separable from the rest of container 110 at a perforated line 111, positioned between a cover panel 126 and a left side panel 118. An attachment strip, or glue tab 145, of container 110 extends from the left side of cover panel 126, as best seen in FIG. 7.

When container 110 is assembled, cover panel 126 is folded around the exterior surface of the container, and glue tab 145 is attached, preferably by adhering, to the interior surface 152 of left side panel 118, as indicated in dashed lines in FIG. 5. At this stage, cover panel 126 is not secured to the container 110. A display opening cover portion 170 of cover panel 126 is then folded into a position against front panel 112 to cover opening 124, and a top opening cover portion 172 of cover panel 126 is folded downwardly and placed over forward portions 150 of the left and right top segments 154,146, as shown in FIG. 6. Container 110 is then taped shut with tape 197 along the seam where top opening cover portion 172 of cover panel 126 meets back top segment 158. A single piece of tape 199 is applied transversely across the seam where display opening cover portion 170 meets right side panel 116.

Although the illustrated container 110 has a simple closure for forming top assembly 120, in which the top opening cover portion 172 abuts the back top segment 158, a tuck closure such as that illustrated and described in conjunction with container 10 could also be used.

To display the contents of container 110, the tape at the top and along the right side is cut open, releasing cover panel 126. Cover panel 126 can then be torn off at the perforated fold 111 on the left side of the container, exposing display opening 124 to allow viewing of and access to the goods within, as indicated in FIG. 5.

Figure 8:
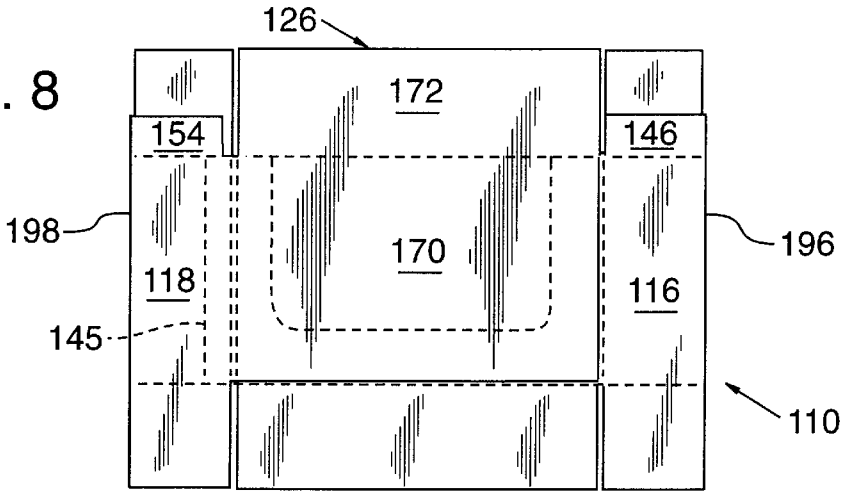
FIG. 8 is a front side view of the container of FIG. 5 shown in a collapsed position.

Container 110 is also collapsible along score lines 196, 198, as shown in FIG. 8.

This description sets forth various embodiments of the present invention for purposes of illustration only. The description should not be construed to limit the scope of the invention in any way. Numerous other modifications and variations can be made to the invention without departing from the invention as defined by the appended claims and their equivalents. For instance, the container need not be entirely orthogonal as illustrated, but could any of multiple shapes.

The invention claimed is:

1. A container comprising:

a top;

a bottom;

at least a first side panel, a second side panel and a third side panel, the side panels being interconnected, each of the first, second and third side panels being contiguous with both the top and bottom, the third side panel having a side edge extending from the top to the bottom, the top, bottom, and the at least first, second and third side panels defining an interior chamber; and a fourth side panel interconnected with the third side panel at the side edge of the third side panel, one of the first and fourth side panels substantially overlying the other of the first and fourth side panels, at least a portion of the fourth side panel being separable from the rest of the container to expose the interior chamber for access thereto.

2. The container of claim 1 in which the fourth side panel is weakened to facilitate removal of the fourth side panel.

3. The container of claim 1 in which the first side panel has an interior side facing the interior chamber and in which the fourth side panel is adjacent the interior side of the first side panel.

4. The container of claim 3 in which the first side panel has an opening and the fourth side panel has an attachment zone for attaching the fourth side panel to the first side panel adjacent the opening.

5. The container of claim 4 in which the fourth side panel has a portion for covering the opening in the first side panel and a top flap portion, and in which the fourth side panel is secured to the rest of the container only at the attachment zone and the top flap portion.

6. The container of claim 1 in which the first side panel has a tab attached thereto for affixing the first side panel to one of the other panels.

7. The container of claim 1 in which the fourth side panel includes a top flap attached thereto.

8. The container of claim 7 in which the top partially encloses the interior chamber and in which the top flap is foldably attached to the fourth side panel, the top flap being foldable from an unassembled position, in which the top flap is coplanar with the fourth side panel, into an assembled position, in which the top flap extends substantially perpendicularly from the fourth side panel and contacts the top to fully enclose the interior chamber.

9. The container of claim 1 in which the first side panel has an exterior side facing away from the interior chamber, and in which the fourth side panel is adjacent the exterior side of the first side panel.

10. The container of claim 1 in which the fourth side panel is shaped to cover the entire opening and overlay a minimal portion of the first side panel adjacent the opening.

11. The container of claim 1 in which the first side panel has the display opening and the fourth side panel includes a weakened line, the weakened line being hidden by the first side panel when the first side panel overlies the fourth side panel.

12. A container comprising:

a top;

a bottom;

at least a first side panel, a second side panel and a third side panel, the side panels being interconnected, each of the first, second and third side panels being contiguous with both the top and bottom, the third side panel having a side edge extending from the top to the bottom, the top, bottom, and the at least first, second and third side panels defining an interior chamber; and a fourth side panel interconnected with the third side panel at the side edge of the third side panel, the first side panel substantially overlying the fourth side panel, the first side panel having an interior side facing the interior chamber and the fourth side panel being adjacent the interior side of the first side panel, the first side panel also having an opening and at least a portion of the fourth side panel being curved to facilitate removal of the fourth side panel, at least a portion of the fourth side panel being separable from the rest of the container to expose the interior chamber for access thereto.

13. A container comprising:

a top;

a bottom;

at least a first side panel, a second side panel and a third side panel, the side panels being interconnected, each of the first, second and third side panels being contiguous with both the top and bottom, the third side panel having a side edge extending from the top to the bottom, the top, bottom, and the at least first, second and third side panels defining an interior chamber; and a fourth side panel interconnected with the third side panel at the side edge of the third side panel, the fourth side panel having an attached top flap with a cutout for facilitating removal of the fourth side panel, one of the first and fourth side panels substantially overlying the other of the first and fourth side panels, at least a portion of the fourth side panel being separable from the rest of the container to expose the interior chamber for access thereto.

14. A container comprising:

a top;

a bottom;

at least a first side panel, a second side panel and a third side panel, the side panels being interconnected, each of the first, second and third side panels being contiguous with both the top and bottom, the third side panel having a side edge extending from the top to the bottom, the top, bottom, and the at least first, second and third side panels defining an interior chamber; and a fourth side panel interconnected with the third side panel at the side edge of the third side panel, the fourth side panel, including an attached top flap, one of the first and fourth side panels substantially overlying the other of the first and fourth side panels, at least a portion of a fourth side panel being separable from the rest of the container to expose the interior chamber for access thereto, wherein the top comprises at least one top panel and the container has a shipping mode in which the top flap is tucked underneath the top panel.

15. The container of claim 14 further having a display mode, in which the interior chamber can be observed, and an attachment zone for attaching the fourth side panel to an adjacent side panel, the container being converted from the shipping mode to the display mode by untucking the top flap from the top panel and detaching the fourth side panel at the attachment zone.

16. A container comprising:

a top;

a bottom;

at least a first side panel, a second side panel and a third side panel, the side panels being interconnected, each of the first, second and third side panels being contiguous with both the top and bottom, the third side panel having a side edge extending from the top to the bottom, wherein at least two of the side panels each have a weakened strip so that those two side panels are foldable along the weakened strip to collapse the container to eliminate the interior chamber, the top, bottom, and the at least first, second and third side panels defining an interior chamber; and a fourth side panel interconnected with the third side panel at the side edge of the third side panel, one of the first and fourth side panels substantially overlying the other of the first and fourth side panels, at least a portion of the fourth side panel being separable from the rest of the container to expose the interior chamber for access thereto.

17. A unitary blank for assembling into a shipping and display container, the blank comprising:

a first side panel defining a cutout, a second side panel foldably attached to the first side panel, a third side panel contiguous with one of the second side panel and the first side panel, each of the first, second and third side panels having a top edge and a bottom edge;

at least one bottom panel foldably attached to a bottom edge of the first, second and third side panels;

at least a first top segment and a second top segment, each foldably attached to one of the first, second and third side panels, the first, second and third side panels, the bottom panel, and top segments being foldable into an assembled position in which the bottom panel and the top segments extend substantially perpendicularly from the first, second and third side panels and in which the top segments form ledges capable of supporting another shipping and display container; and a cover for covering the cutout in the assembled position, the cover being foldably attached to one of the first, second and third side panels, the bottom, and the first and second top segments and covering the cutout in the assembled position.

18. The blank of claim 17 in which the cover has a weakened area to allow removal of the cover from the rest of the container.

19. The blank of claim 17 in which the cover includes an attachment strip for attaching the cover to the first side panel.

20. The blank of claim 17 in which the cover is foldably attached to the third side panel.

21. The blank of claim 17 in which the cover has a top flap foldably attached thereto, the top flap being foldable into an assembled position in which the top flap adjoins at least one of the top segments to define an interior chamber and to substantially enclose the interior chamber.

22. A shipping and display container comprising:

a plurality of panels, including multiple side panels, a bottom panel, and a top panel, each of the side panels having side edges extending between the bottom and top panels, one of the side panels defining a display opening; and a cover attached to one of the side edges of one of the side panels, the cover for closing the display opening.

23. A shipping and display container comprising:

a plurality of panels, including multiple side panels, a bottom panel, and a top panel, each of the side panels having side edges extending between the bottom and top panels, one of the side panels defining a display opening; and a cover attached to one of the side edges of one of the side panels, the cover for closing the display opening, wherein the plurality of panels and cover are formed from a unitary blank.

24. The container of claim 23 in which the plurality of panels and cover have a display mode in which the display opening is exposed and a shipping mode, in which the side panel having the display opening overlies the cover, thereby covering the display opening.

25. The container of claim 23 in which the cover is detachable from the container.

26. The container of claim 23 in which the container has an attachment strip for affixing the plurality of side panels in an upright position, the attachment strip being integral with the side panel having the display opening and the cover.

27. The container of claim 23 in which the plurality of panels define an interior chamber having a top, the top panel only partially enclosing the top of the chamber, and in which the cover has a front flap and a top flap adjacent the front flap, the top flap covering a portion of the top of the chamber.

28. The container of claim 27 in which the top panel extends over a portion of the top flap and the top flap can be untucked from underneath the top panel.

29. A container comprising:

multiple side panels, a top panel;

a bottom panel;

one of the panels having a display opening;

a cover attached to one of the panels for covering the display opening; and a flap attached to the cover, the flap extending underneath one of the panels and being untuckable therefrom.

30. The container of claim 29 in which the flap has a weakened portion to facilitate untucking the flap from underneath the said one of the panels.

31. The container of claim 29 in which the flap has a hole to facilitate untucking the flap from underneath the said one of the panels.

32. The container of claim 29 in which one of the side panels is a front side panel and another of the side panels is a back side panel, and the top panel extends from the back side panel to a location forward of a plane lying about midway between the front and back side panels.

33. The container of claim 29 in which the flap has at least one chamfered corner to facilitate untucking the flap.

34. The container of claim 29 further including at least one piece of tape attached to the panel underneath and against which the flap lies and at least one of the side panels the flap being substantially untouched by the tape.

35. The container of claim 34 in which the container has a shipping mode and a display mode and in which the tape is affixed to the panel underneath which the flap lies in both the shipping and display modes.

36. The container of claim 29 in which the flap is secured to the rest of the container only by being restrained underneath the said panel.

37. A shipping and display container comprising:

a top assembly;

a bottom assembly opposite the top assembly;

a side panel assembly bridging the top panel assembly and the bottom panel assembly and including a first side panel having a display opening, a second side panel contiguous with the first side panel, a third side panel contiguous with the second side panel, and a fourth side panel contiguous with the third side panel and the first side panel; and a cover for covering the display opening, the cover being contiguous with one of the first and fourth sides, two of the side panels each having a score that extends substantially from the top panel assembly to the bottom panel assembly, the first, second, third, and fourth side panels, the top assembly, the bottom assembly, and the cover having an assembled position, in which an interior chamber is defined, and a collapsed position, in which the interior chamber is eliminated by folding each of the two side panels having a score upon itself at the respective score so that the top, bottom, and side panel assemblies are flat. the chamber, and in which the cover has a front flap and a top flap adjacent the front flap, the top flap covering a portion of the top of the chamber.

38. The shipping and display of claim 37 in which the top panel assembly has a first top segment and a second top segment, the bottom panel assembly has a first bottom segment and a second bottom segment, the first top segment and the first bottom segment being contiguous with the second side panel, the second top segment and the second bottom segment being contiguous with the fourth side panel, the second side panel and fourth side panel each having a score that extends substantially from the top panel assembly to the bottom panel assembly, the first and second top segments and the first and second bottom segments each having a score substantially aligned with the corresponding score in the second and fourth side panels, and in which each of the first and second top segments and the first and second bottom segments extends substantially perpendicularly from the side panels to help define the interior chamber in the assembled position, and in which the first top and bottom segments and the second top and bottom segments are coplanar with the second and fourth side panels in the collapsed position, each of the first and second top segments, and the first and second bottom segments folding upon itself at the respective score in the collapsed position so that the top, bottom, and side panel assemblies are flat.

* * * * *

UNITED STATES PATENT AND TRADEMARK OFFICE

CERTIFICATE OF CORRECTION

PATENT NO. : 5,950,914
DATED : September 14, 1999
INVENTOR(S) : Kevin M. Dunton et al.

It is certified that error appears in the above-identified patent and that said Letters Patent is hereby corrected as shown below:

Claims:

Column 12,
Lines 20-22, delete "the chamber, and in which the cover has a front flap and a top flap adjacent to the front flap, the tip flap covering a portions of the tip of the chamber.".

Signed and Sealed this

Twenty-first Day of August, 2001

*Attest:*

Nicholas P. Godici

NICHOLAS P. GODICI
*Acting Director of the United States Patent and Trademark Office*

*Attesting Officer*